US005280272A

United States Patent [19]

Nagashima et al.

[11] Patent Number: 5,280,272

[45] Date of Patent: Jan. 18, 1994

[54] FIRE ALARM SYSTEM WHICH DISTINGUISHES BETWEEN DIFFERENT TYPES OF SMOKE

[75] Inventors: Tetsuya Nagashima, Sagamihara; Masato Aizawa, Hachiouji, both of Japan

[73] Assignee: Hochiki Kabushiki Kaisha, Tokyo, Japan

[21] Appl. No.: 944,362

[22] Filed: Sep. 14, 1992

[30] Foreign Application Priority Data

Sep. 20, 1991 [JP] Japan ..... 3-241162
Oct. 31, 1991 [JP] Japan ..... 3-285825

[51] Int. Cl.[5] ..... G08B 17/10

[52] U.S. Cl. ..... 340/630; 340/628; 356/340; 356/341; 356/343; 250/574; 250/575

[58] Field of Search ..... 340/630, 628, 632; 356/340, 341, 343, 348, 339; 250/573, 574, 575

[56] References Cited

U.S. PATENT DOCUMENTS 4,103,997 8/1978 Araki et al. ..... 356/340
4,524,281 6/1985 Muggli et al. ..... 340/630 X

*Primary Examiner*—Jeffrey Hofsass
*Attorney, Agent, or Firm*—Max Fogiel

[57] ABSTRACT

A fire alarm system which radiates light towards a smoke detecting space. Scattered light resulting from smoke that may exist in the smoke detecting space is judged by a receiver with respect to the type of smoke that may prevail in the space. The presence of a fire is judged by comparing the light that has been received with a set threshold level. The threshold level is set to different levels in accordance with the type of smoke detected.

9 Claims, 6 Drawing Sheets

| TYPE OF FIRE \ ANGLE | 30° | 60° | 90° | 120° |
|---|---|---|---|---|
| LIQUID BURNING FIRE (KEROSENE) | 0.16 [1.0] | 0.09 [0.56] | 0.07 [0.44] | 0.12 [0.75] |
| SMOKING FIRE (COTTON WICK) | [1.0] | [0.27] | [0.12] | [0.20] |

FIRE ALARM SYSTEM WHICH DISTINGUISHES BETWEEN DIFFERENT TYPES OF SMOKE

BACKGROUND OF THE INVENTION

Field of the Invention

The present invention relates to fire alarm systems for detecting presence of a fire and type of smoke from the scattered light caused by the smoke at the time of fire. More particularly, it relates to a fire alarm system which, in view of the fact that the scattering angle and the degree of polarization are different by types of smoke, is designed to be capable of more accurately judging a fire by varying the threshold for judging a fire based on the difference in the types of smoke.

Description of the Related Art

A scattered light type smoke detector is known as a system for judging a fire from the scattered light caused by smoke which is produced by the fire. In such a system, as shown in FIG. 10, a light emitting element 2, such as a light emitting diode, for irradiating a light having a directivity toward the central portion X of a smoke detection chamber (space for detecting a smoke) is provided to face the central portion X. In addition, a light receiving lens 4 and a light receiving element 6 such as a photodiode are positioned so that their optical axes coincide at a predetermined angle (hereinafter referred to as scattering angle) $\theta$ with respect to the optical axis of the light emitting element 2. Further, the light emitting element 2 irradiates a light having directivity along the direction of its optical axis and the light receiving element 4 gathers and concentrates the scattered light via the light receiving lens 4 provided on the light receiving plane. Moreover, a comparator 8 is provided, which outputs a detection signal S0 indicating starting of a fire when the output signal of the light receiving element 6 exceeds a predetermined threshold.

Thus, judgment on fire is made on the principle that there is a correlation between the scattered light incident on the light receiving element 6 and the density of smoke in the space for detecting smoke. That is, at a normal condition where no fire is taking place, the intensity of the scattered light reaching the light receiving element 6 is low as a smoke 10 does not enter the smoke detection chamber. On the other hand, the intensity of the scattered light reaching the light receiving element 6 is increased upon entering of the smoke 10 caused by a fire. A threshold of the comparator 8 is set on the basis of this principle, and presence of a fire is detected by judging that a fire has been started when the output signal of the light receiving element 6 exceeds the predetermined threshold level.

Such a conventional scattered light type smoke detector, however, is not provided with a function for determining the type of smoke. In other words, a conventional system merely judges the presence of a fire by simply comparing the density of smoke entered into the space for detecting smoke with a uniformly determined threshold level.

In reality, however, there are various differences that occur according to the burned material between the smoke produced by burning such as gasoline and the smoke produced by burning smodering timber, with respect to their color and diameter of particles. A smoke consisting of smaller particles is relatively dark in color while a smoke consisting of larger particles becomes white. In this case, the amount of light reflected by the black smoke is relatively less and, accordingly, there occurs a phenomenon that the intensity of the scattered light detected at the light receiving element varies even though the smoke density within the smoke detecting space is identical. For this reason, making a judgment on fire on the basis of a uniformly determined threshold level irrespective of types of smoke has been the cause of such problems as judging a false fire to be a fire or causing a delay in the judgment on fire.

Also, empirically, such facts are widely known that a scattered light type smoke detector placed in a room filled for example with a cigarette smoke is erroneously operated by the cigarette smoke even though no fire is taking place therein. Further, there is another problem that a delay is caused in judgment on fire with respect to a black smoke produced by burning such as oil and gasoline because the intensity of the scattered light therefrom is relatively low.

SUMMARY OF THE INVENTION

The present invention has been made in view of the problems of the conventional system as described, and it is an object of the present invention to provide a fire alarm system for performing a proper fire detection in accordance with types of smoke which is the subject for detection.

The present invention achieves the above described object such that—in a fire alarm system having light emitting means for irradiating a light toward a smoke detecting space and light receiving means for receiving the scattered light caused by a smoke existing in the smoke detecting space, determining the existence of smoke by the received light output of the light receiving means and judging the presence of fire by comparing the received light output with a preset threshold—type of the smoke is determined and, on the basis of the determined type, the above threshold is changed to a preset threshold which is previously determined correspondingly to each smoke type.

Further, the present invention preferably includes: storage means for storing as a plurality of characteristic data for each type of smoke the received light outputs, previously obtained through experiments, of said light receiving means at the time of varying the scattering angle formed by the optical axis of said light emitting means and the optical axis of said light receiving means; and judging means for judging type of smoke by comparing and collating the received light output of the light receiving means obtained for each scattering angle formed by the optical axis of said light emitting means and the optical axis of said light receiving means, with the characteristic data in said storage means.

Further, a light is irradiated toward the smoke detecting space; the light intensity of each of the lights different in their direction of polarization is obtained from the scattered light which is caused by the smoke existing in the smoke detecting space; the degree of polarization is calculated from these light intensities; the type of smoke is determined on the basis of the degree of polarization; and presence of a fire is judged by further comparing the threshold set correspondingly to thus determined type of smoke and these light intensities.

According to a fire alarm system of the present invention constructed as described, since there is a unique correlation for each type of smoke between the scattering angle formed by the respective optical axes of the light emitting means and the light receiving means and the received light output of the light receiving means, the characteristic of the smoke may be known on the basis of the respective received light output for each scattering angle. Then, by comparing it with the characteristic data for each type of smoke which is previously stored in the storage means, the type of smoke at starting of a fire may be determined.

A unique correlation also exists between the degree of polarization which is obtained on the basis of scattered lights different in their degree of polarization and the type of smoke. Thereby, the type of smoke may be determined.

A threshold for determining presence of fire is set correspondingly to the determined smoke type. The final judgment on the presence of fire is made by comparing the relative magnitude of the threshold and the light intensity of the scattered light. Thus, the accuracy in judgment is improved comparing to a conventional system where presence of a fire is judged by a uniformly determined threshold irrespective of types of smoke, whereby an erroneous alarming may be prevented.

DESCRIPTION OF THE PREFERRED EMBODIMENTS

Figure 1:
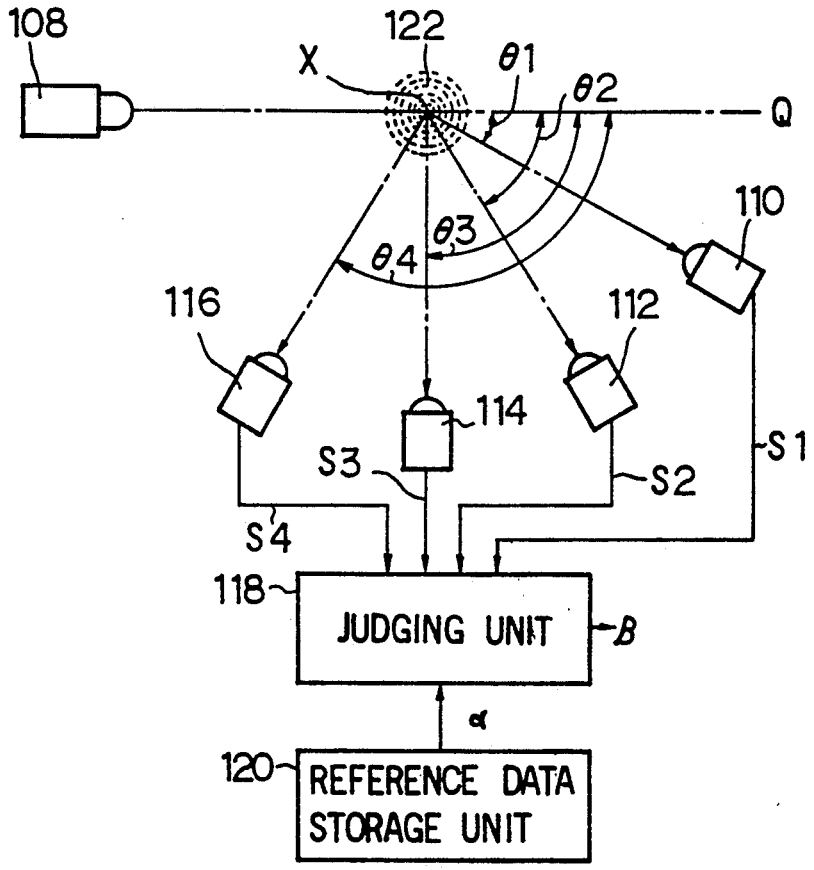
FIG. 1 is a block diagram illustrating the construction of a first embodiment of the present invention.

Some preferred embodiments of the present invention will now be described with reference to the drawings. FIG. 1 is a block diagram illustrating the construction of a first embodiment of the present invention. First, the construction of the first embodiment is described by way FIG. 1. Numeral 108 denotes a light emitting element such as a light emitting diode having directivity, emitting a light where its optical axis Q is directed toward the center portion X of the smoke detection chamber.

Numerals 110, 112, 114, 116 respectively denote light receiving elements such as of photodiodes. Here, angles are set such that: the angle $\theta 1$ formed by the optical axis of the first light receiving element 110 and the optical axis Q of the light emitting element 108 is 30°; the angle $\theta 2$ formed by the optical axis of the second light receiving element 112 and the optical axis Q of the light emitting element 108 is 60°; the angle $\theta 3$ formed by the third light receiving element 114 and the optical axis Q of the light emitting element 108 is 90°; and the angle $\theta 4$ formed by the fourth light receiving element 116 and the optical axis Q of the light emitting element 108 is 120°.

Numeral 118 denotes a judging unit for receiving output signals S1, S2, S3, S4 from the respective light receiving elements 110, 112, 114, 116. This judging unit 118 furthermore compares these signals S1–S4 with data $\alpha$ in a reference data storage unit 120 to judge presence of fire occurrence and type of smoke. In addition, when a fire occurs, it outputs a information data $\beta$ indicating the occurrence of fire and the type of smoke thereof. It should be noted that such as microprocessor having memory function incorporated therein is preferably used as the judging unit 118 and the reference data storage unit 120.

Next, the principle of this embodiment for detecting the type of smoke is described. On the basis of many experiments and researches conducted, the present inventor has verified the fact that, even when the smoke density within a smoke detection chamber is kept at constant, the received light intensity received by the light receiving element is different if the angle $\theta$ formed by the light emitting element and the light receiving element is different. Furthermore it has been verified that the correlation between such scattering angle $\theta$ and the received light intensity has a unique characteristic for each type of smoke.

Figure 2:
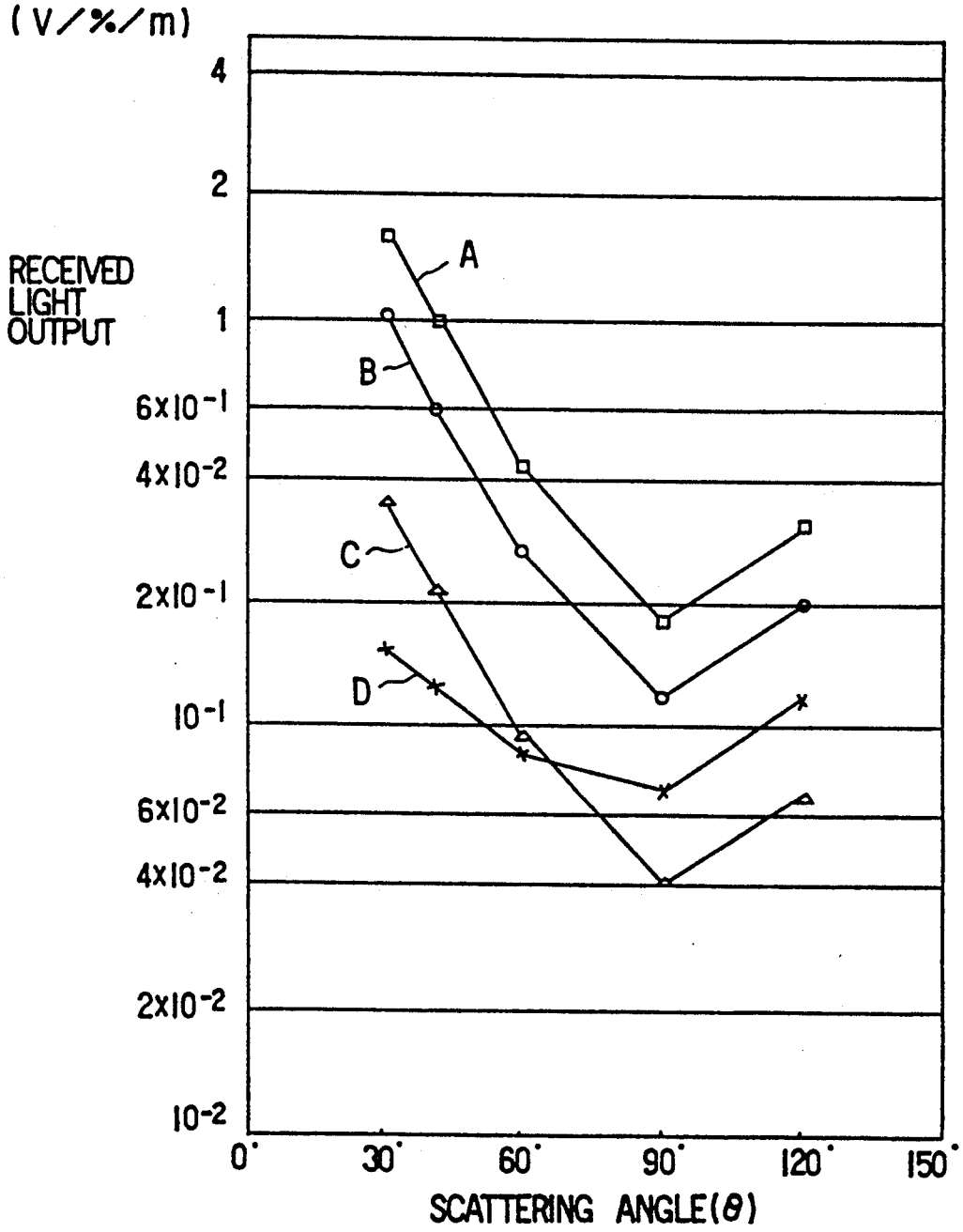
FIG. 2 is a diagram for explaining the principle of smoke discrimination of the first embodiment.

FIG. 2 shows an example of the result of such experiments, where the horizontal axis represents the scattering angle $\theta$ and the vertical axis represents an output voltage (hereinafter referred to as received light output) provided by the light receiving element when the smoke detection chamber is filled with a predetermined density (1.0%/ m) of smoke. Here, A ~D in the figure respectively represent: measured result A for the smoke generated when filter paper was burned; smoldering measured result B for the smoke of cotton wick; measured result C for the smoke of a stick of incense; and measured result D for the smoke of kerosene.

Figures 3, 4:
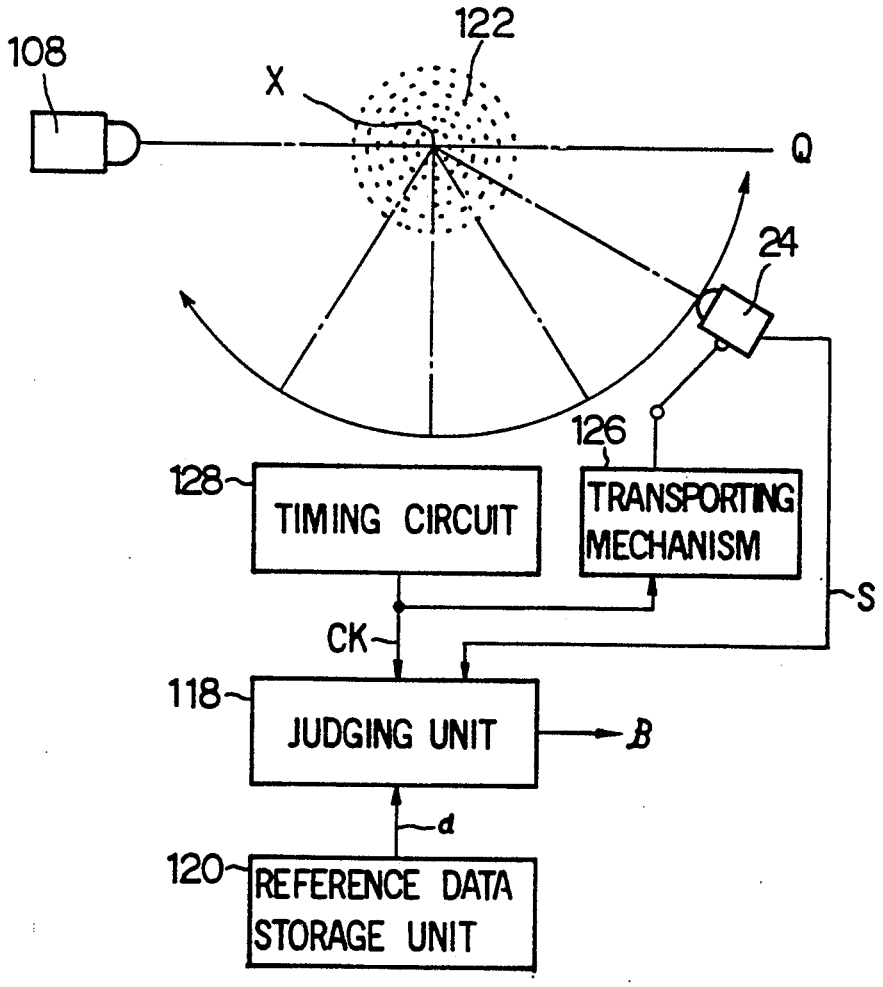
FIG. 3 is another diagram for explaining the principle of smoke discrimination of the first embodiment.
FIG. 4 is a block diagram illustrating the construction of a second embodiment of the present invention.

The chamber output for each scattering angle $\theta$ with respect to kerosene and cotton wick may be represented in a table as shown in FIG. 3. It should be noted that values indicated in the parentheses are the values obtained by putting the chamber output at the time of the scattering angle $\theta = 30°$ to 1.0 and normalizing the other outputs.

As is apparent from FIG. 2, FIG. 3, there is a unique characteristic for each type of smoke.

On the other hand, normalized data for each scattering angle $\theta$ with respect to various types of smoke are previously stored in the reference data storage unit 120. Thus, the judging unit 118 obtains by means of pattern matching the correlation between the changing pattern of detection signals S1–S4 from the light receiving elements 110–116 and the data in the reference data storage unit 120, and it decides the type of smoke which is most close correlated. Thereby, the type of smoke 122 which has entered the smoke detection chamber is determined.

Furthermore, a threshold is previously determined for each type of smoke in the judging unit 118. For example, an occurrence of fire is judged when the chamber output at the time of the scattering angle $\theta = 30°$ exceeds the threshold based on a type of smoke. That is, presence of fire is determined on the basis of a criterion which is independently set for each type of smoke.

In this manner, if a fire is determined on the basis of the determination on the type of smoke and the threshold set for each type of smoke, presence of fire occurrence may be judged accurately without being affected by a difference in the amount of the scattered light corresponding to type of smoke.

For example, a specific difference as shown in FIG. 2 exists between the chamber output for a white smoke produced from a filter paper or cotton wick and the chamber output for a black smoke produced from kerosene.

Accordingly, by setting the threshold for judging a fire which produces a white smoke to a value larger than the threshold for judging a fire which produces a black smoke, the accuracy of judgment may be improved comparing to the conventional case where a threshold is set as the criterion. Specifically, false fire alarms due to tobacco or white steam may be reduced and a detection of fire may be performed quicker than it has been conventionally possible with respect to black smokes produced by burning oil or the like.

A second embodiment will now be described with reference to FIG. 4.

It should be noted that, in FIG. 4, those components identical or corresponding to those in FIG. 1 are denoted by the same reference numerals.

In this embodiment, instead of placing a plurality of light receiving elements respectively at scattering angles $\theta$, a single light receiving element 124 is provided, which is moved by a transporting mechanism 126 to the scattering angles of 30°, 60°, 90° and 120° facing the smoke detection chamber.

In this case, timing for reciprocating the light receiving elements 124 through the scattering angles $\theta$ and timing for inputting to the judging unit 118 the detection output S of the light receiving elements 124 are synchronized with a clock signal CK of a timing circuit 128. At this time, the judging unit 118 determines the type of smoke by comparing the detected output S for all the scattering angles $\theta$ and the smoke data previously stored in the reference data storage unit 120 by means of pattern matching. Occurrence of fire is then judged by making a comparison with a threshold previously set for each smoke type. According to this embodiment, the number of light receiving elements may be reduced.

Figure 5:
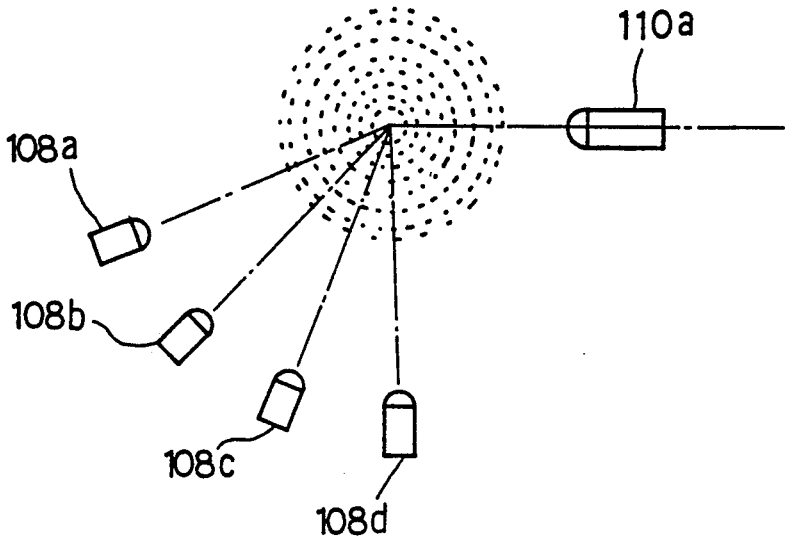
FIG. 5 is a block diagram illustrating the construction of a third embodiment of the present invention.

FIG. 5 is a block diagram illustrating a third embodiment of the present invention, which is characterized in that a plurality of light emitting elements 108*a*–108*d* are provided. In such embodiment, the light emitting elements 108*a*–108*d* are sequentially emitted and the light is synchronously received by the light receiving element 110*a*. Type of smoke is then judged by comparing the data of the received light and the smoke data which has been previously stored.

It should be noted that, while four scattering angles $\theta$ at 30°, 60°, 90°, 120° are used in the embodiments of FIG. 4 and FIG. 5, it is also possible to take measurements at more finely divided angles.

Further, since it is possible to detect the characteristic of a smoke for determining the type of the smoke by using at least two scattering angles, only two scattering angles $\theta$ may be employed if the types of smoke to be produced at the starting of fire are limited to a small number. By limiting the number of the scattering angles $\theta$ to such a small number, it is possible to achieve an improvement in signal processing speed.

Furthermore, while these embodiments have been described with respect to a case where means for determining the type of smoke is used as a known scattered light type smoke detector by incorporating it together with an optical system having light emitting element and light receiving element, it may also be constructed so that the signal processing section such as of judging unit and the reference data storage unit may be separately provided on a receiver or a repeater. In this manner, the sensor portion for detecting the smoke may be reduced in size and weight and the system may easily be applied to a fire alarm system such as of a conventionally used polling type.

A fourth embodiment according to the present invention will now be described with reference to the drawings.

Figure 6:
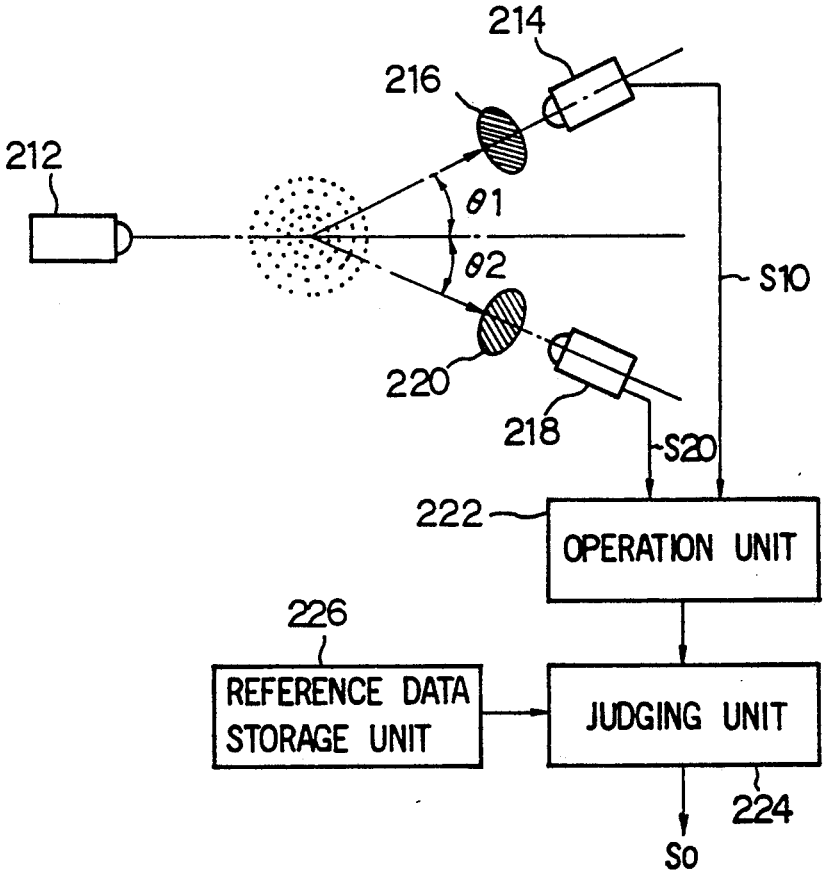
FIG. 6 is a block diagram illustrating the construction of a fourth embodiment of the present invention.

Referring to FIG. 6, numeral 212 denotes a light emitting element by which a light having directivity is irradiated toward the center portion X of the smoke detecting space. For this, such as a halogen lamp which emits a light having a plurality of frequency components is suitably used.

Numeral 214 denotes a first light receiving element such as of a photodiode. Its optical axis is provided such that a predetermined scattering angle $\theta 1$ is formed with respect to the direction of the optical axis of the light emitting element 212.

Numeral 216 denotes a first polarizing filter. Here, the first polarizing filter 216 is set in its plane of polarization so that the light received output is maximized of the light receiving element 214 which receives the scattered light caused by smoke, and it is provided in the front of the light receiving surface of the first light receiving element 214.

Numeral 218 denotes a second light receiving element such as of a photodiode. Its optical axis is provided such that a predetermined scattering angle $\theta 2$ is formed with respect to the direction of the optical axis of the light emitting element 212. Note that, in this embodiment, both of the scattering angles $\theta 1$ and $\theta 2$ are set to 30°.

Numeral 220 denotes a second polarizing filter having a plane of polarization which is 90° different from the first polarizing filter. This is so set that the received light output of the light receiving element 218 is minimized when a scattered light exists, and is provided in the front of the light receiving plane of the second light receiving element 218.

Numeral 222 denotes an operation unit to which output signals S10, S20 respectively of the first and second light receiving elements 214, 218, and the degree of polarization C of the light passed through the polarizing filters 16, 20 is calculated by conducting a calculation of the formula as shown below on the basis of the output levels of these signals.

$$C=(S1-S2)/(S1+S2) \quad (1)$$

Numeral 224 denotes a judging unit which compares the degree of polarization C and a threshold Tth for judging type of a smoke and judges the type of the smoke based on the relative magnitude between the degree of polarization C and the threshold value Tth. In addition, a threshold Tv for detecting a fire is set for each type of smoke. Thus, when the output level of the output signals S10, S20 of the first and second light receiving elements 214, 218 is detected to exceed the threshold value Tv, it is judged that a fire has started and a fire alarm signal So is delivered.

In other words, since the threshold Tth is set to judge type of smoke in a similar manner as in the foregoing embodiments and the threshold Tv is a unique threshold corresponding to the type of smoke which is judged on the basis of the threshold Tth, a fire detection in accordance with type of smoke is possible.

Numeral 226 denotes a reference data storage unit for previously storing the data which is used by the judging unit as criteria of the conditions of a started fire. The reference data storage unit 226 stores data related to type of combustibles in the monitored region for which the scattered light type smoke detector of this embodiment is provided, and it also stores data of a plurality of thresholds Tth corresponding to the set angle of the scattering angles $\theta 1$ and $\theta 2$ respectively of the first and second light receiving elements 214, 218 and data of thresholds Tv.

Further, though not indicated in the figure, once data of the types of combustibles and the scattering angles $\theta 1$, $\theta 2$ of the first and second light receiving elements 214, 218 have been initially set by means such as of a initialization switch, the unique thresholds Tth and Tv for the respective data are thereafter supplied to the judging unit 224. The judging unit 224 then judges the type of smoke and presence of a fire on the basis of these thresholds Tth, Tv.

In this manner, by providing the reference data storage unit 226, it is possible to deal with various types of fire that are previously assumed in accordance with the conditions in the monitored region.

Next, the operation of the embodiment which is constructed in the above manner is described together with its fire detecting principle.

First, a description will be given with respect to the fire detecting principle applied to this embodiment. The present inventor has verified through a number of experiments and researches that, even when the smoke density in the smoke detection chamber of a scattered light type smoke detector is identical, each type of smoke has a unique characteristic according to the difference in the scattering angle $\theta$ formed by the optical axes of the light emitting element and the light receiving element and the degree of polarization C. While the foregoing embodiments are based on the unique characteristics of the relation between the scattering angle $\theta$ and the intensity of the received light, the present embodiment is based on the unique characteristic between the scattering angle $\theta$ and the degree of polarization C.

Figure 7:
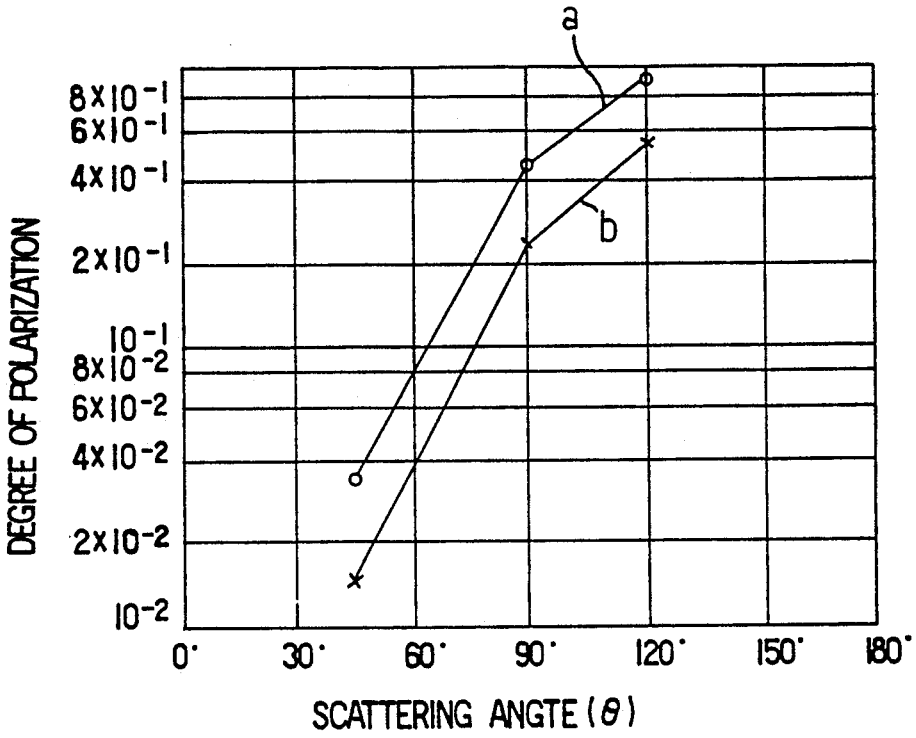
FIG. 7 is a diagram for explaining the principle of smoke discrimination of the fourth embodiment.

FIG. 7 shows an example of the results of such experiments, where the horizontal axis represents the scattering angle $\theta$ and the vertical axis represents the degree of polarization when a predetermined density (1.0%/m) of smoke is filled within the smoke detecting space, the vertical axis being represented in a logarithmic scale. Naturally, the degree of polarization does not change even though the density of smoke is changed.

Here, the characteristic curve "a" represents the measured result for the smoke caused by kerosene (liquid burning fire), while the characteristic curve "b" represents the measured result for the smoke caused by a cotton wick (smoking or smoldering fire).

As is apparent from FIG. 7, it can be seen that a unique correlation exists for each type of smoke between the degree of polarization and the scattering angle $\theta$.

Accordingly, the present inventor has decided to judge type of fire from the value of the degree of polarization at predetermined scattering angles.

For example, the type of smoke is judged such that, after setting the scattering angles $\theta 1 = \theta 2 = 60°$ and setting the threshold Tth to 0.05, the relative magnitude between the degree of polarization C and the threshold Tth is detected.

The operation will now be described. First, at the time of installing the sensor, the types of smoke which will supposedly be produced at the time of fire are designated by initializing the types of combustibles provided within he monitored area and the scattering angle $\theta$.

A light is irradiated from the light emitting element 212 and the operation unit 222 obtains the degree of polarization C by performing at a predetermined period $\tau$ the calculation of the above described formula (1) with respect to photoelectric conversion signals S10 and S20 which are delivered from the first light receiving element 214 and the second light receiving element 218.

The judging unit 224 compares the above degree of polarization C with the threshold Tth in synchronism with period $\tau$. If the degree of polarization exceeds the threshold Tth, a first threshold Tv1 for detecting the smoke caused by a liquid burning fire is then automatically read from the reference data storage unit 226. By contrast, if the degree of polarization C is smaller in value than the threshold Tth, a second threshold Tv2 for detecting the smoke caused by a smoldering fire is automatically read out from the reference data storage unit 226, whereby the threshold Tv is set in accordance with a liquid burning fire or smoldering fire.

If, upon setting of the threshold Tv1, the output level of the photoelectric conversion outputs S10, S20 of the first and second light receiving elements 214, 218 exceeds the threshold Tv1, it is judged as a liquid burning fire and the fire alarm signal So is provided. On the other hand, if the threshold Tv1 is not exceeded, it is judged as not a fire and the monitoring operation is continued without providing the fire alarm signal So. Further, if, upon setting of the threshold Tv2, the output level of the photoelectric conversion outputs S10, S20 of the first and second light receiving elements 214, 218 exceeds the threshold Tv2, it is judged as a smoldering fire and the fire alarm signal So is provided. If the threshold Tv2 is not exceeded, it is judged as not a fire and the monitoring operation is continued without providing the fire alarm signal So.

In this manner, according to this embodiment, an accurate fire alarm is possible as is the case in the foregoing embodiments, since the type of smoke by fire is judged and presence of a fire is judged further on the basis of a specified threshold Tv set for each type of smoke.

While, in this embodiment, a case has been described, where the operation unit 222, the judging unit 224 and the reference data storage unit 226 are incorporated into a scattered light type smoke detector, it is also possible to construct, in a similar manner as described above, such that only the optical system of the light emitting element 212, the first and second light receiving elements 214, 218 and the optical filters 216, 220 is incorporated into a scattered light type smoke detector, and the operation unit 222, the judging unit 224 and the reference data storage unit 226 for performing operation and judgment based on the photoelectric conversion outputs S10, S20 are provided on a so-called receiver or repeater. Further, the scattering angle $\theta$ may suitably be determined.

Moreover, while, in this embodiment, the type of smoke is determined by calculating the degree of polarization C based on the above described formula (1), a calculated result C' of the following formula (2) may be used as an approximation for the degree of polarization in a simpler calculation method.

$$C' = S1/S2 \quad (2)$$

Next, a fifth embodiment is described with reference to FIG. 8. Note that, in FIG. 8, those components identical or corresponding to those in FIG. 6 are denoted by the same reference numerals.

Figure 8:
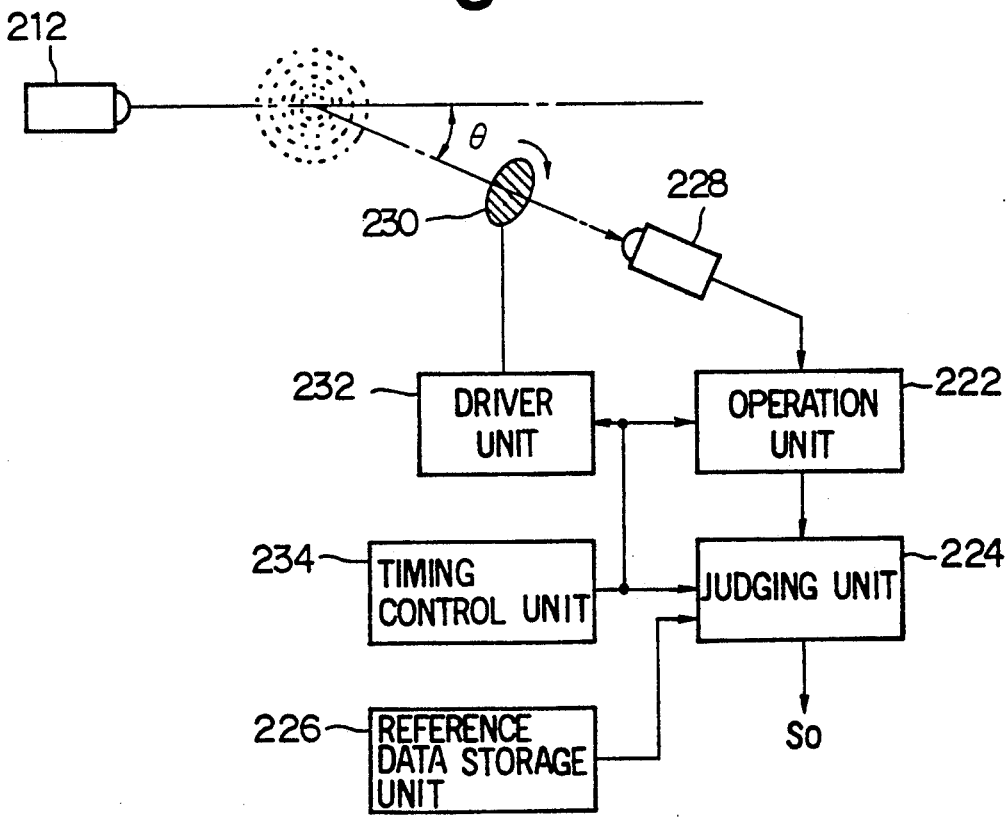
FIG. 8 is a block diagram illustrating the construction of a fifth embodiment of the present invention.

Referring to FIG. 8, a light receiving element 228 is provided such that the scattering angle thereof with respect to the optical axis of the light emitting element 212 is set to $\theta$, and a polarization filter 230 rotatable at a predetermined angular velocity about the optical axis of the light receiving element 228 is provided in the front of the light receiving surface of the light receiving element 228.

Numeral 232 denotes a driver unit such as of a motor for rotating the polarization filter 230 at a constant speed, and it rotates at a constant speed in synchronism with a synchronizing signal from a timing control unit 234.

Therefore, as the rotating angle of the polarization filter 230 changes, the degree of polarization thereof changes and the light receiving element 228 receives a scattered light corresponding to the change in the degree of polarization.

Further, the photoelectric conversion output S10 of the light receiving element 214 when the plane of polarization of the polarization filter 230 is at 0° and the photoelectric conversion output S20 of the light receiving element 214 when the plane of polarization of the polarization filter 230 is at 90° are input to the operation unit 222 in synchronism with a synchronizing signal from the timing control unit 234. The degree of polarization C is obtained by performing the calculation of the above described formula (1) or (2) at each time the polarization filter 230 is rotated by 360°.

The judging unit 224, in a similar manner as in the fourth embodiment, performs setting of threshold values Tv1 and Tv2 on the basis of the degree of polarization C and judges presence of a fire occurrence under the respective set conditions.

According to this embodiment, the number of the polarization filter may be reduced.

Figure 9:
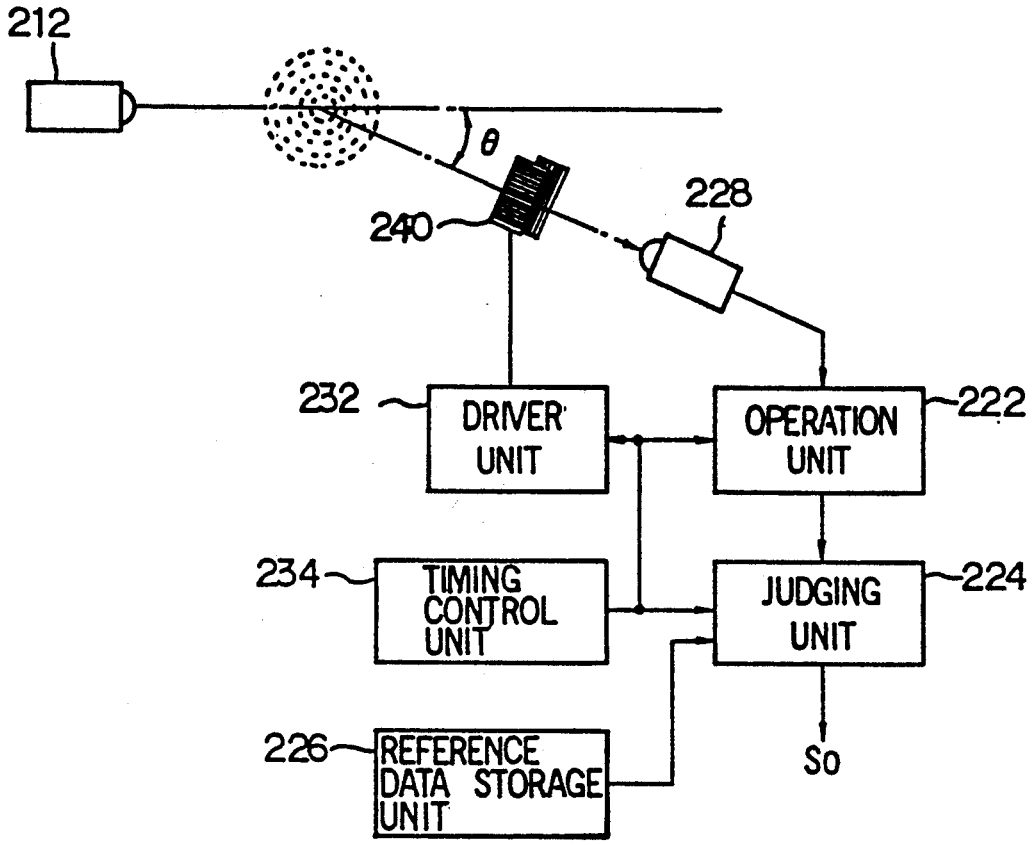
FIG. 9 is a block diagram illustrating the construction of a sixth embodiment of the present invention.
Figure 10:
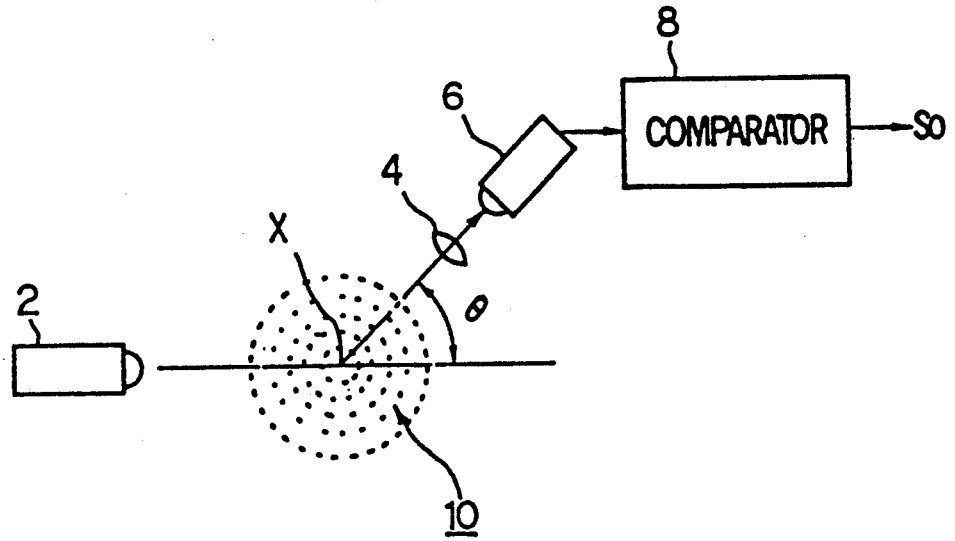
Fig.10 PRIOR ART
FIG. 10 is a block diagram for explaining the construction of a conventional scattered light type smoke detector.

FIG. 9 is a block diagram illustrating the construction of a sixth embodiment according to the present invention.

In the present embodiment, an electronic polarizing plate 240 using liquid crystal is provided instead of the rotating polarization filter 230 of the fifth embodiment. The electronic polarizing plate 240 is changed by 90° in the angle of its plane of polarization upon conduction of an electric current. Thereby, the light receiving element 228 receives the scattered light in accordance with the change in the degree of polarity. The other part of its operation is similar to that in the fifth embodiment.

Here, the electronic polarizing plate 240 is constructed such that glass sheets to which transparent electrodes are applied are placed at an interval of about 10 μm and a liquid material called liquid crystal is injected and sealed therein. The array of the molecules of a liquid crystal in this condition is formed into a spiral and exhibits the property of rotary polarization (rotating the plane of polarization). Further, when a voltage is applied across the two electrodes, the array of liquid crystal molecules is arranged into a straight line in the direction of the electric field and the rotary polarization thereof will be lost. Thus, by turning ON/OF the voltage, the angle of the plane of polarization may be changed of the light incident on the light receiving element 228.

While, in these embodiments, the type of smoke is determined on the basis of the degrees of polarization when the difference in the angles of plane of polarization is set to 90°, it is not specifically limited to 90° and the type of smoke may be judged on the basis of the degree of polarization at other suitable angles.

What is claimed is:

1. A fire alarm system having light emitting means for irradiating a light toward a smoke detecting space and light receiving means for receiving the scattered light caused by smoke existing in the smoke detecting space, judging the existence of and the type of smoke bye the received light output of the light receiving means, and judging the presence of a fire by comparing said received light output and a set threshold level, said threshold level being set to different levels in accordance with the type of smoke detected.

2. A fire alarm system according to claim 1, further comprising:

storage means for storing a plurality of characteristic data for each type of smoke the received light outputs, previously obtained through experiments, of said light receiving means at the time of varying a scattering angle formed by the optical axis of said light emitting means and the optical axis of said light receiving means; and judging means for judging the type of smoke by comparing and collating the received light output of the light receiving means obtained for each scattering angle formed by the optical axis of said light emitting means and the optical axis of said light receiving means with the characteristic data in said storage means.

3. A fire alarm system according to claim 2, further comprising transportation means for varying said scattering angle by making movable said light emitting means or said light receiving means.

4. A fire alarm system according to claim 1, wherein a plurality of said light receiving means are provided correspondingly to a plurality of predetermined scattering angles and said judging means judges the type of smoke on the basis of the received light outputs of the respective light receiving means.

5. A fire alarm system according to claim 1, wherein a plurality of said light emitting means are provided correspondingly to a plurality of predetermined scattering angles and said judging means judge the type of smoke on the basis of the received light outputs at the time of the emission of the respective light emitting means.

6. A fire alarm system according to claim 1, further comprising:

a polarizing filter passing the scattered light caused by smoke in the smoke detecting space and capable of being changed in the angle of its plane of polarity;

light receiving means for receiving light passed through said polarizing filter;

operation means for calculating the degree of polarization on the basis of a first output provided by said light receiving means when the plane of polarization of said polarizing filter is at a first angle and a second output provided by said light receiving means when the plane of polarization of said polarizing filter is at a second angle; and judging means for judging the type of the smoke from the comparison of the degree of polarization calculated by said operation means with previously set characteristic data for detecting smoke and for judging the presence of a fire on the basis of the relative magnitude of the threshold for detecting a fire corresponding to the judged type of smoke and the output of the first or second light receiving means.

7. A fire alarm system according to claim 1, further comprising:

an electronic polarizing plate passing the scattered light caused by smoke existing in the smoke detecting space and capable of being changed by 90° in the angle of its plane of polarization upon conducting of electric current;

light receiving means for receiving light passed through said electronic polarizing plate;

operation means for calculating the degree of polarization on the basis of a first output provided by said light receiving means when the plane of polarization of said electronic polarizing plate is at a first angle and a second output provided by said light receiving means when the plane of polarization of said electronic polarizing plate is at a second angle; and judging means for judging the type of the smoke from the relative magnitude of the degree of polarization calculated by said operation means and a previously set threshold for detecting smoke and for judging the presence of a fire on the basis of the relative magnitude of the threshold for detecting a fire corresponding to the judged type of smoke and the output of the first or second light receiving means.

8. A fire alarm system according to claim 1, wherein the types of smoke to be judged are white smoke and black smoke.

9. A fire alarm system according to claim 1, further comprising:

a first polarizing filter having its plane of polarization pass only the light in a predetermined plane of polarization of the scattered light caused by smoke existing in the smoke detecting space;

a second polarizing filter having its plane of polarization pass only the light in the plane of polarization different from the direction set by the first polarization filter of the scattered light caused by the smoke existing in the smoke detecting space;

a first light receiving means for receiving the light transmitted through the first polarizing filter;

a second light receiving means for receiving the light transmitted through the second polarizing filter;

operation means for calculating the degree of polarization on the basis of the output of the first light receiving element and the output of the second light receiving element; and judging means for judging the type of smoke from the comparison of the degree of polarization calculated by said operation means with previously set characteristic data for detecting smoke and for judging the presence of a fire on the basis of the relative magnitude of the threshold level for detecting a fire corresponding to the judged type of smoke and the output of the first or second light receiving means.

* * * * *